United States Patent [19]

DiNovo et al.

[11] Patent Number: 4,850,199

[45] Date of Patent: Jul. 25, 1989

[54] CRYO-REFRIGERATION SYSTEM

[75] Inventors: Salvatore T. DiNovo; John Schlaechter, both of Columbus; Roy S. Brown, Worthington, all of Ohio

[73] Assignee: Guild Associates, Inc., Columbus, Ohio

[21] Appl. No.: 170,438

[22] Filed: Mar. 21, 1988

[51] Int. Cl.[4] ..... F25B 1/00

[52] U.S. Cl. ..... 62/114; 62/335; 62/467

[58] Field of Search ..... 62/335, 467, 114

[56] References Cited

U.S. PATENT DOCUMENTS

| | | | |
|---|---|---|---|
| 3,817,046 | 6/1974 | Aoki et al. | 62/335 |
| 4,441,332 | 4/1984 | Wilkinson | 62/335 |
| 4,667,485 | 5/1987 | Ball et al. | 62/335 |

*Primary Examiner*—Ronald C. Capossela

*Attorney, Agent, or Firm*—Frank H. Foster

[57] ABSTRACT

Multiple refrigeration systems, each with refrigerants having a different boiling point, are connected in series to provide successively lower temperatures. Following compression and heat rejection, the refrigerant mixture is cooled by heat exchange with refrigerant returning to the compressor. Gas and liquid phases are separated and the gas is cooled further by heat exchange with mixture returning to the compressor. System capacity is controlled by throttling the compressor suction.

8 Claims, 1 Drawing Sheet

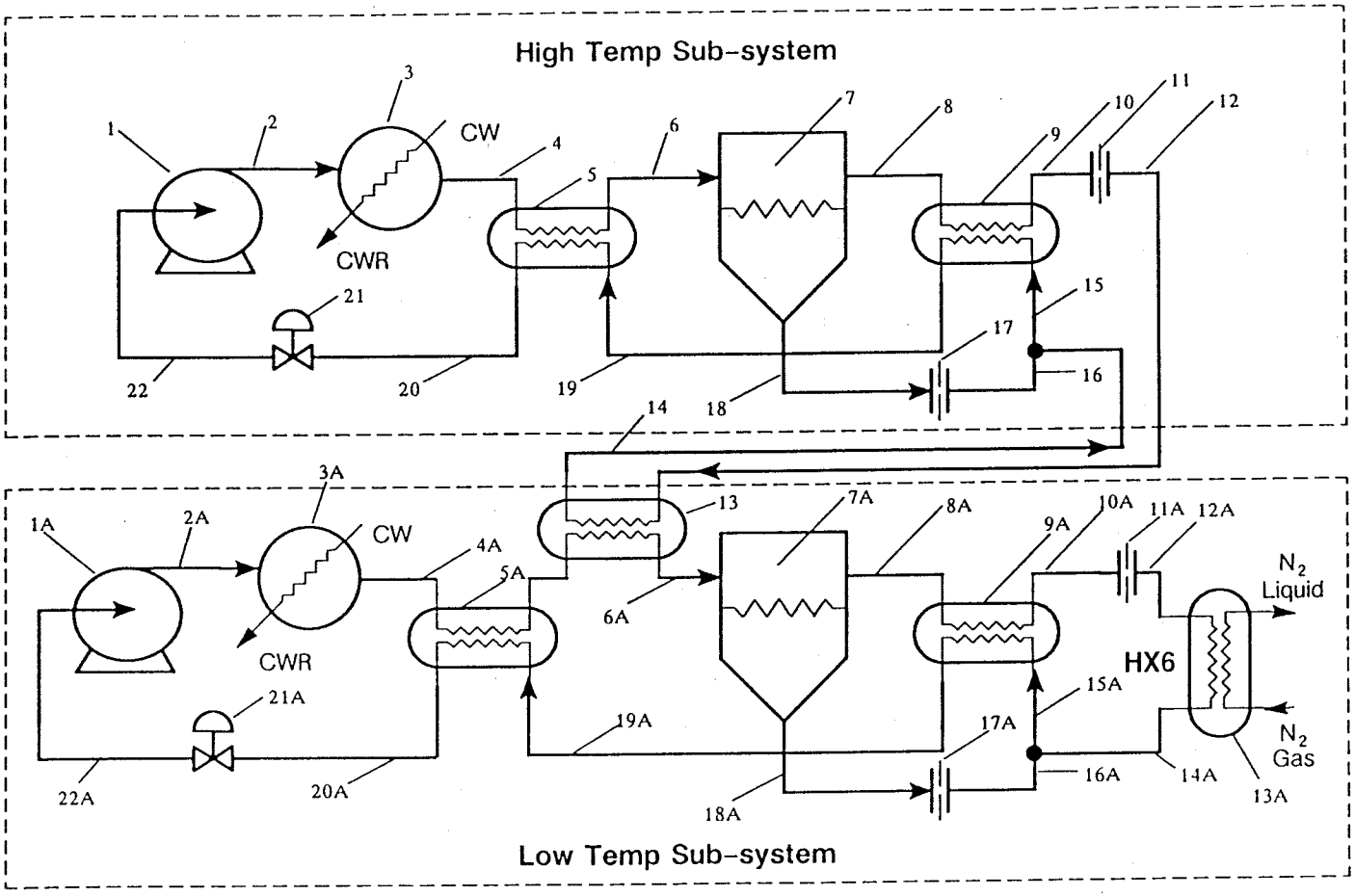
High Temp Sub-system
Low Temp Sub-system
HX6
$N_2$ Liquid
$N_2$ Gas
CW
CWR
1
2
3
4
5
6
7
8
9
10
11
12
13
14
15
16
17
18
19
20
21
22
1A
2A
3A
4A
5A
6A
7A
8A
9A
10A
11A
12A
13A
14A
15A
16A
17A
18A
19A
20A
21A
22A

CRYO-REFRIGERATION SYSTEM

Production of refrigeration at very low temperatures has always presented a challenge. Heat must be removed at a very low temperature and converted so that it may be rejected at ambient temperature. Thermodynamically, the greater the difference between the rejection temperature and the final refrigeration temperature, the more energy will be required to remove a given quantity of heat. The challenges are to minimize the energy input to the refrigeration system and simplify the mechanical complexity of the system. The subject of this invention addresses both requirements.

Mechanical refrigeration systems typically circulate a fluid to transfer heat. The fluid is compressed to some pressure, which raises the temperature of the fluid enough so that heat may be rejected to some heat sink. The cooled, compressed fluid is then expanded to a lower pressure. If no energy is recovered in the expansion, then the expansion is adiabatic. This means that the enthalpy, the heat content, of the fluid is the same on both sides of the expansion device. Valves, orifices, and capillary tubing are typical devices used to adiabatically expand the fluid. If energy is recovered from the expansion, then the expansion approaches an isentropic process. This means that the entropy is nearly the same on both sides of the expansion device. Isentropic expansion is typically achieved by using a turbine or a reciprocating engine operated by the fluid. The expanded fluid drops in temperature due to the expansion and is able to absorb heat from a source at this lower temperature. The fluid warmed by the heat source may be further warmed by heat exchange with the pressurized fluid before being recompressed by the compressor.

Refrigeration systems which use a single component as the working fluid, in which condensation takes place at the high pressure, are limited by the physical properties of that component. For instance, with heat rejection taking place at ambient temperature, a minimum, practical refrigeration temperature is about −40° F. Three methods are currently used to achieve lower temperatues: use of a non-condensing fluid, use of a fluid mixture, or a cascade refrigeration system. In each case the work required to achieve a liquid nitrogen temperature of 77° K. is about ten times the heat energy removed.

The non-condensing fluid system is most efficient when the expansion is done isentropically. This means that the process is more practical in large scale systems.

In a fluid mixture refrigeration system, various compositions of the mixture are liquefied at the set high pressure and several temperature levels. At each temperature the liquid is separated from the fluid stream and flashed to a common low pressure. The flashed liquid is then heat exchanged with the gas stream to condense a new liquid stream at a lower temperature. The process is repeated until a flashed liquid is available at the desired refrigeration temperature. The type of components and amounts of each must be chosen so that a sufficient amount of liquid is formed at each of the temperature levels. To produce refrigeration at 77° K., four liquid streams are typically produced and three to four liquid/vapor separators are required. Only one compressor is required to maintain the high and low pressures in the system.

A cascade utilizes multiple refrigeration systems operated in series. Each system uses a fluid component chosen for its performance over the operating temperature range of that system. The warmest system rejects heat at ambient temperature, and absorbs the reject heat from the next system in line. Each succeeding system operates over a colder temperature range until the desired refrigeration temperature is achieved.

It is the object of this invention to combine cascade and mixed refrigerants concepts in a unique way to provide the energy efficiency of the cascade system with the simplicity of the mixed refrigerant system.

In the present invention two or three mixed refrigerant systems are connected in series to supply progressively lower temperature levels. Each of the systems utilizes a unique refrigerant fluid composed of one or more components. These components may be hydrocarbons, halocarbons, inert gases, or other substances commonly used as refrigerants. Each system requires a gas compressor. Each mixture is formulated to provide sufficient liquid at the required operating temperatures.

In further discussions it is important to keep in mind the difference in behavior of a mixture as opposed to a pure component. At a given pressure, the bubble point of a fluid is the temperature at which the liquid boils to form the first incremental amount of gas. The dew point is the temperature at that pressure at which the gas condenses to form the first incremental amount of liquid. For a pure component, the bubble point and dew point are identical. For a fluid mixture the bubble point occurs at a lower temperature than the dew point. The temperature difference between the two points will depend on the properties of the components in the mixture. In both cases, The enthalpy of the fluid at the dew point will be greater than at the bubble point.

FIG. 1 presents a flow schematic of the present invention as applied to the three system concept. The high temperature system absorbs reject heat from the low temperature system and rejects it at ambient conditions. The low temperature system then absorbs heat from compressed nitrogen which then condenses to a liquid. Flashing the nitrogen to low pressure constitutes the third system which provides even lower temperature refrigeration.

The following discussion uses FIG. 1 to describe the operation of the present invention in general terms. Operation of the high temperature system will be explained first. Compressor 1 boosts the chosen gas mixture to a desired pressure. This pressure is essentially present in items numbered 2 through 10 and in item 18. As the gas flows through each item, the pressure will decrease due to the flow and resistance of each item. Compression of the mixture increases the enthalpy and temperature of the mixture. Flow conduit 2 directs the pressurized gas mixture to heat exchanger 3. Heat exchanger 3 removes enthalpy from the gas mixture thus lowering the temperature, and rejects the heat to the environment. By way of example, the FIGURE shows cooling water, CW, being used to remove heat, but any suitable fluid could be used. The cooled gas mixture leaves heat exchanger 3 by means of conduit 4 and enters heat exchanger 5. At this point, some of the mixture may or may not have been condensed to a liquid. In heat exchanger 5 the gas mixture is contacted, through a separating heat transfer surface, with a colder gas mixture flowing in the opposite direction. The gas mixture leaves the heat exchanger through conduit 6 at a lower temperature, and with given fraction of the mixture condensed to liquid. The mixture components with relatively high boiling point temperatures predominate in the gas phase, while the lower boiling point components predominate in the liquid phase. The two phases of the mixture enter separator 7 where the liquid and gas phases are separated into two streams. The gas phase leaves through flow conduit 8, and the liquid leaves through conduit 18. The gas stream is cooled in heat exchanger 9 in the same manner as in heat exchanger 5, except that the temperature is now even lower. A significant fraction of the stream is liquefied and leaves heat exchanger 9 by means of conduit 10. Conduit 10 conducts the fluid stream to expansion device 11 which reduces the pressure of the fluid to the desired level in a manner which approaches an adiabatic operation as described previously. Valves, orifices, and capillary tubing are typical devices used to adiabatically expand the fluid.

The desired low pressure level is essentially maintained from items numbered 12 through 16 and 19 through 21. The pressure drops according to the flow resistance of each item in the low pressure circuit. The expansion of the fluid into conduit 12 results in a lowering of the fluid temperature. The ratio of the amounts of liquid and gas in this stream will depend on the physical conditions of the fluid in conduit 10. For instance, if the temperature in conduit 10 is sufficiently below the bubble point, then the fluid in conduit 10 will be totally liquid and subcooled. With sufficient subcooling, the expanded fluid will also be completely liquid.

The fluid in conduit 12 is transferred into heat exchanger 13 to produce the desired refrigeration. This fluid absorbs heat from the source of heat at the desired temperature by two mechanisms. The liquid absorbs a large amount of heat as it vaporizes to form gas. This is called the heat of vaporization. The cold gas absorbs a lesser amount of heat as its temperature rises. This is called latent heat. The fluid mixture leaves the heat exchanger 13 by means of conduit 14. The temperature of the fluid is higher than at the entrance and its heat content has increased by the amount of refrigeration supplied. The desired amount of liquid remaining in conduit 14 will depend on the refrigeration required in heat exchangers 5 and 9.

Liquid from separator 7 is transported through conduit 18 to expansion device 17. The operation of items 18 through 16 is similar to the described operation of items 10 through 12, as previously discussed. The fluids in conduits 16 and 14 are combined into conduit 15 and transferred into heat exchanger 9. The fluid increases in temperature as it absorbs heat from the fluid from conduit 8. At every point in heat exchanger 9, the temperature of the conduit 15 fluid is less than the fluid from conduit 8. This enable heat to be transferred into stream 15 fluid. It should be noted at this point that the heat of vaporization of each component increases as pressure is decreased. This means that the amount of gas condensed on the warm side of heat exchangers 5, 9, and 13 will be greater than the corresponding amounts of liquid vaporized on the cold side of the heat exchangers.

Fluid exits heat exchanger 9 through conduit 19 and is transferred to heat exchanger 5. Sufficient liquid must be available to condense the required amount of liquid produced in heat exchanger 5. After increasing in enthalpy and temperature, the fluid exits by means of conduit 20 and introduced to flow control 21. Flow control valve 21 adjusts the total flow of fluid through the system to match the refrigeration load. When the required refrigeration load decreases, the valve partially closes and this drops the pressure in conduit 22 which supplies fluid to the suction port of compressor 1. As the suction pressure is decreased the compressor is able compress less fluid.

Operation of the low temperature system is exactly the same as for the high temperature system except for the operation of heat exchanger 13. This heat exchanger provides refrigeration to the low temperature system so that heat can be rejected at a temperature below ambient. As a result, all of the temperatures to the right of heat exchanger 13 are much colder in the low temperature system than the corresponding points in the high temperature system.

Another identical system could be added to provide even lower temperature refrigeration. FIG. 1 shows another alternative to this option. Pressurized nitrogen gas is liquefied by the refrigeration from the low temperature system. The liquefied nitrogen is then expanded to a lower pressure to provide a colder temperature source of refrigeration.

A specified embodiment of FIG. 1 has been computer simulated to predict performance. The composition of the fluids are reported in pound-moles per hour for each component. Stream 1 identifies the composition in items 1 through 6, 19 through 22, and 15. Stream 2 identifies the composition in items 8 through 14. Stream 3 identifies the composition in items 16 through 18.

| | Stream 1 | Stream 2 | Stream 3 |
|---|---|---|---|
| Dichlorodifluoromethane (R-12) | 6.309 | 2.004 | 4.306 |
| Chlorotrifluoromethane (R-13) | 1.992 | 1.437 | 0.555 |
| Carbon Tetrafluoride (R-14) | 6.802 | 6.261 | 0.541 |

With these compositions, about 20% of the fluid is liquefied in conduit 4 at 300° K. A total of 36% of the fluid is liquefied in conduit 6 at 288.7° K. The flashed fluid in conduit 16 is at 248. 3 K. and is 60% liquid. The flashed fluid in conduit 12 is at 177.7 K. and is 48% liquid. Heat exchanger 13 supplies 17,700 Btu/Hr of refrigeration. Fluid from conduit 12 is warmed to 200.2° K. and the liquid content decreases to 25%. On the warm side of heat exchanger 13 the fluid is cooled from 201.3° to 183.4° K. Refrigeration is recovered from the fluid in conduit 15 by warming from 221.4° K. to 291.4° K. at conduit 22. The system high pressure is 280 psia and the low pressure is 30 psia.

Stream 4 identifies the composition in items 1A through 6A, 19A through 22A, and 15A. Stream 5 identifies the composition in items 8A through 14A. Stream 6 identifies the composition in items 16A through 18A.

| | Stream 4 | Stream 5 | Stream 6 |
|---|---|---|---|
| Chlorotrifluoromethane (R-13) | 2.182 | 0.572 | 1.610 |
| Carbon Tetrafluoride (R-14) | 3.611 | 2.771 | 0.840 |
| Argon | 14.007 | 13.512 | 0.495 |

With these compositions, about 1.6% of the fluid is liquefied in conduit 4A at 201.3° K. A total of 15% of the fluid is liquefied in conduit 6A at 183.4° K. The flashed fluid in conduit 16A is at 162° K. and is 72% liquid. The flashed fluid in conduit 12A is at 97.7° K. and is 65% liquid. Heat exchanger 13A supplies 17,700 Btu/Hr of refrigeration. Fluid from conduit 12A is warmed to 104° K. and the liquid content decreases to 34%. On the warm side of heat exchanger 13A the fluid is cooled at 105.1° K. from 6 to 100% liquid. Refrigeration is recovered from the fluid in conduit 15A by warming from 115.3° K. to 310.9° K. at conduit 22A. The system high pressure is 250 psia and the low pressure is 27 psia.

What is claimed is:

1. A mechanical refrigeration process in which two or more systems are connected in series to provide successively lower temperature levels; Each system utilizes mixtures of refrigerants having different boiling points and employing the following steps:

a. Compression of the mixture to a suitable pressure,
b. Rejection of compression heat to the environment,
c. Cooling the mixture by heat exchange with mixture returning to the compressor,
d. Separation of the liquid and gas phases,
e. Further cooling of the separated gas mixture, to form liquid, by heat exchange with mixture returning to the compressor,
f. Expansion of the liquid to a given lower pressure to achieve the desired low temperature,
g. Absorption of heat by the expanded fluid from step f to provide refrigeration,
h. Expansion of the liquid from step d to the lower pressure of step f and mixing of this expanded fluid with the used fluid of step g,
i. Heat exchange of the fluid from step h to satisfy the requirements of steps c and e,
j. Controlling the capacity of the system by throttling the compressor suction.

2. The process of claim 1 wherein the third system uses a pure component rather than a mixture and consists of the following steps:

a. The pure component is compressed to the desired pressure,
b. The heat of compression is rejected to the environment, and the fluid is further cooled by heat exchange with pure component returning to the compressor,
c. Heat of compression is rejected to the refrigerant of the second system and the pure component is condensed to a liquid,
d. The liquid is expanded to a given lower pressure to yield the desired refrigeration temperature,
d. The expanded liquid is used to supply refrigeration,
e. The used fluid from step d is heat exchanged in step b and returned to the suction of the third system compressor.

3. The process of claims 1 and/or 2 wherein fewer compressors are needed than in an equivalent cascade refrigeration system.

4. The process of claims 1 and/or 2 wherein fewer separators are needed than in an equivalent mixed refrigerant system.

5. The process of claims 1 and/or 2 wherein all equipment items with moving parts are limited to the ambient temperature portion of the process.

6. The process of claims 1 and/or 2 wherein the expansion device used in steps f and h is a fixed orifice.

7. The process of claims 1 and/or 2 wherein the expansion device used in steps f and h is a capillary tube.

8. The process of claims 1 and/or 2 wherein the expansion device use in steps f and h is a valve.

* * * * *